US006872141B2

(12) United States Patent
Kaneko

(10) Patent No.: US 6,872,141 B2
(45) Date of Patent: Mar. 29, 2005

(54) CRAWLER DRIVING DEVICE AND GAME DEVICE

(75) Inventor: Makoto Kaneko, Tokyo (JP)

(73) Assignee: Sega Corporation, Tokyo (JP)

( * ) Notice: Subject to any disclaimer, the term of this patent is extended or adjusted under 35 U.S.C. 154(b) by 274 days.

(21) Appl. No.: 09/959,124

(22) PCT Filed: Feb. 23, 2001

(86) PCT No.: PCT/JP01/01377

§ 371 (c)(1),
(2), (4) Date: Apr. 8, 2002

(87) PCT Pub. No.: WO01/62357

PCT Pub. Date: Aug. 30, 2001

(65) Prior Publication Data

US 2002/0137568 A1 Sep. 26, 2002

(30) Foreign Application Priority Data

Feb. 23, 2000 (JP) ..... 2000-46566

(51) Int. Cl.[7] ..... A63H 18/14

(52) U.S. Cl. ..... 463/62; 463/58; 463/61

(58) Field of Search ..... 463/58, 61, 62–69, 463/59, 60; 446/129, 134–136, 433, 219, 444, 443, 446; 273/142 R, 442, 459, 246; 356/614; 104/295; 320/106

(56) References Cited

U.S. PATENT DOCUMENTS

| | | | | | |
|---|---|---|---|---|---|
| 1,641,638 | A | * | 9/1927 | McCoy | 273/142 R |
| 1,709,512 | A | * | 4/1929 | Alderdice | 273/442 |
| 2,116,767 | A | * | 5/1938 | Joseph | 273/459 |
| 3,707,804 | A | * | 1/1973 | Cook | 463/63 |
| 3,823,941 | A | * | 7/1974 | Ochi et al. | 463/61 |
| 3,844,557 | A | * | 10/1974 | Pompetti | 463/58 |
| 3,986,296 | A | * | 10/1976 | Hamano | 446/136 |
| 3,986,717 | A | * | 10/1976 | Kirby et al. | 463/62 |
| 4,306,375 | A | * | 12/1981 | Goldfarb et al. | 446/219 |
| 4,522,606 | A | * | 6/1985 | Goldfarb et al. | 446/433 |
| 4,545,776 | A | * | 10/1985 | Law | 446/443 |
| 4,547,166 | A | * | 10/1985 | Goldfarb et al. | 446/164 |
| 4,616,829 | A | * | 10/1986 | Smack et al. | 463/6 |
| 4,774,679 | A | * | 9/1988 | Carlin | 702/41 |
| 4,817,948 | A | * | 4/1989 | Simonelli | 463/6 |
| 4,937,207 | A | * | 6/1990 | Simmell et al. | 463/62 |
| 5,452,893 | A | * | 9/1995 | Faulk et al. | 463/68 |
| 5,501,455 | A | * | 3/1996 | Hirata et al. | 463/61 |
| 5,596,567 | A | * | 1/1997 | deMuro et al. | 320/106 |
| 5,676,586 | A | * | 10/1997 | James | 446/444 |
| 5,688,175 | A | * | 11/1997 | Matsuura et al. | 463/61 |
| 5,800,263 | A | * | 9/1998 | Hayashida et al. | 463/6 |
| 5,928,058 | A | * | 7/1999 | Francis et al. | 446/446 |
| 5,976,019 | A | * | 11/1999 | Ikeda et al. | 463/61 |
| 6,019,369 | A | * | 2/2000 | Nakagawa et al. | 273/246 |
| 6,109,186 | A | * | 8/2000 | Smith et al. | 104/295 |
| 6,380,714 | B1 | * | 4/2002 | Chou | 320/114 |
| 6,394,898 | B1 | * | 5/2002 | Nagao et al. | 463/6 |
| 6,473,070 | B2 | * | 10/2002 | Mishra et al. | 345/158 |
| 6,498,458 | B1 | * | 12/2002 | Chen | 320/114 |
| 6,608,688 | B1 | * | 8/2003 | Faul et al. | 356/614 |

FOREIGN PATENT DOCUMENTS

| | | | |
|---|---|---|---|
| JP | 07068056 | A | 3/1995 |
| JP | 07-068056 | * | 3/1995 |
| JP | 08294206 | A | 11/1996 |
| JP | 09205733 | A | 8/1997 |
| JP | 11090035 | A | 4/1999 |

* cited by examiner

*Primary Examiner*—John M. Hotaling, II
*Assistant Examiner*—Yveste Cherubin
(74) *Attorney, Agent, or Firm*—Dickstein Shapiro Morin & Oshinsky LLP

(57) ABSTRACT

A crawler driving apparatus and a game apparatus in which a storage battery mounted on a crawler is charged with electricity in a state that the crawler is adjacent to or not separated from a runway surface. In the crawler driving apparatus, the crawler 50 has a storage battery to self run by electric power of the storage battery, a charger 70 is disposed at a stand-by position of the crawler, and the storage battery is charged with electricity by the charger in a state that the crawler is not separated from a runway surface.

5 Claims, 18 Drawing Sheets

Prior Art

CRAWLER DRIVING DEVICE AND GAME DEVICE

TECHNICAL FIELD

The present invention relates to a crawler driving apparatus and a game apparatus in which a storage battery mounted on a crawler is charged with electricity.

BACKGROUND ART

In a conventional crawler for game mounted with a storage battery, when charging of the battery becomes necessary, the crawler is taken out from a game apparatus and the storage battery is connected to a charger for charging in a state that the storage battery is mounted on the crawler, or the storage battery is taken out from the crawler.

However, since the crawler is disposed within a closed space under a runway surface, it is troublesome and difficult to take out the crawler outside. Therefore, the charging takes much labor and time.

When the crawler is housed in a game apparatus, whether the storage battery needs charging or not can not be foreseen. Therefore, the storage battery must be charged early before the crawler becomes not able to self run during game. As the result, life of the storage battery is short because the number of times of charge of the storage battery is limited.

DISCLOSURE OF INVENTION

The present invention overcomes the above difficulties, and an object of the invention is to make the charge easy.

The present invention provides a crawler driving apparatus, wherein a crawler has a storage battery to self run by electric power of said storage battery, a charger is disposed at a stand-by position of said crawler to where said crawler can self run, and said storage battery is charged with electricity by said charger in a state that said crawler is adjacent to or not separated from a runway surface.

According to this invention, even if the crawler is housed within a closed space or surrounded by various members, the storage battery can be charged without moving the crawler from the runway surface outside or taking out the crawler.

The present invention provides a crawler driving apparatus, wherein a crawler has a storage battery to self run by electric power of said storage battery, a charger is disposed at a stand-by position of said running body to where said crawler can self run, said crawler moves automatically to said charger in a state that said crawler is adjacent to or not separated from a runway surface, and said storage battery is charged with electricity by said charger. The storage battery can be charged easily by moving the crawler to the charger automatically.

The present invention provides a crawler driving apparatus, wherein a crawler has a storage battery to self run by electric power of said storage battery, a charger is disposed at a stand-by position of said crawler to where said crawler can self run, said crawler moves automatically to said charger in a state that said crawler is adjacent to or not separated from a runway surface, and said storage battery is automatically charged with electricity by said charger. Charging of the storage battery can be carried out very efficiently.

The crawler may be a self running model. Even if the self running model is housed within a closed space or surrounded by various members, the storage battery can be charged easily and efficiently without moving the self running model from the runway surface outside or taking out the self running model.

The crawler may be connected to a model for running the model. Even if the crawler is housed within a closed space or surrounded by various members, the storage battery can be charged easily and efficiently without moving the crawler from the runway surface outside or taking out the crawler.

The model and the crawler may disposed on and under a runway plate respectively, and the model may be connected to the crawler by magnetic attraction and may run on the runway plate following the crawler. The storage battery can be charged easily and efficiently without taking out the crawler positioned under the runway plate from the space under the runway plate.

The storage battery may be automatically charged with electricity by the charger when the crawler has run by a predetermined time or distance. The storage battery can be charged automatically, when the storage battery necessitates charge, without using a special charge condition detecting means. Therefore, life of the storage battery of which the number of times of charge is limited can be prolonged.

A charge condition detecting means for detecting whether the storage battery is required to be charged with electricity or not may be provided, and the storage battery on the crawler returned to the stand-by position may be charged with electricity by the charger when the charge condition detecting means detects a condition requiring charge. A state that necessitates charge can be caught surely for charging the storage battery automatically. Therefore, life of the storage battery of which the number of times of charge is limited can be prolonged do the maximum for cost-down.

The crawler may be controlled by a run control means provided on the runway surface side, the run control means may transmit a run control signal for moving the crawler to the charger to the crawler when information requiring charge detected by the charge condition detecting means is transmitted to the run control means by wireless, and the crawler may move to the charger so that the storage battery in the crawler is charged with electricity by the charger. The crawler which can run freely moves to the charger automatically and the storage battery of the running body can be charged automatically.

The running body may return to the stand-by position provided with the charger after the crawler has run on the runway surface, and when charge is required by the charge condition detecting means, a terminal of the charger and a terminal of the storage battery of the crawler may be connected with each other to charge the storage battery. With respect to a certain running time or distance of the crawler, the number of times of charge of the storage battery can be reduced as possible to prolong life of the storage battery.

The crawler may return to the stand-by position provided with the charger after the crawler has run on the runway surface, and when operation of the crawler is to be stopped for long time, an electric circuit within the crawler may be cut off. Discharge of the storage battery during operation of the crawler is stopped can be restrained as possible to improve durability of the storage battery.

The crawler may have an electric source switch for cutting and connecting an electric source circuit and charge terminals for charging the storage battery, the charger may have connection terminals capable of connecting with the charge terminals of the storage battery, and when the charge terminals of the storage battery and the connection terminals of the charger are connected with each other, the electric source switch may be cut off. In a state that the storage battery is connected to the charger, charge of the storage battery can be performed smoothly, and when the charge has finished and the storage battery and the charger remain in the connected state, discharge of the storage battery is restrained to ensure enough charge quantity per one charge.

The charge terminals of the storage battery and the connection terminals of the charger may form three sets of terminals, a set of terminals may be those for charging, another set of terminals may be those for transmitting quantity of remaining electricity of the storage battery and further set of terminals may be earth terminals of the terminals for charging and the terminals for transmitting quantity of remaining electricity. When the storage battery is charged by the charger, remaining electricity in the storage battery can be grasped surely to perform proper charge.

The present invention provides a game apparatus having a plurality of models running along a predetermined course toward a goal to emulate for order of arrival, wherein each of said models has a storage battery as electric source for running and self runs along a runway surface, respective connecting sections to a charger are disposed corresponding to said self running models at stand-by positions of said self running models, and said storage battery of said self running model is charged with electricity by said charger in state that said self running model is adjacent to or not separated from said runway surface. According to this game apparatus, even if the crawler is housed within a closed space or surrounded by various members, the storage battery can be charged without moving the crawler from the runway surface outside or taking out the crawler.

The present invention provides a game apparatus having a plurality of models running along a predetermined course toward a goal to emulate for order of arrival, wherein said model is connected to a crawler self running along a runway surface, said crawler has a storage battery as electric source for running, a charger is disposed at a stand-by position of said running body, and said storage battery of said crawler is charged with electricity by said charger. The storage battery can be charged when the game has been over and the crawler stands by.

The present invention provides a game apparatus having a plurality of models running along a predetermined course toward a goal to emulate for order of arrival, wherein each of said models has a storage battery as electric source for running and self runs along a runway surface, respective connecting sections to a charger are disposed corresponding to said self running models at stand-by positions of said self running models, said self running model moves to said charger automatically in a state that said self running model is adjacent to or not separated from said runway surface, and said storage battery is charged with electricity by said charger. The storage battery can be charged easily by moving the crawler to the charger automatically.

The present invention provides a game apparatus having a plurality of models running along a predetermined course toward a goal to emulate for order of arrival, wherein each of said models has a storage battery as electric source for running and self runs along a runway surface, respective connecting sections to a charger are disposed corresponding to said self running models at stand-by positions of said self running models, said self running model moves to said charger automatically in a state that said self running model is adjacent to or not separated from said runway surface, and said storage battery is charged with electricity by said charger automatically. Charging of the storage battery can be carried out very efficiently.

A charge condition detecting means for detecting whether the storage battery is required to be charged with electricity or not may be provided, and the storage battery on the self running model or body may be charged with electricity by the charger when the charge condition detecting means detects a condition requiring charge. In the above-mentioned game apparatus, a state that necessitates charge can be caught surely for charging the storage battery automatically. Therefore, life of the storage battery of which the number of times of charge is limited can be prolonged to the maximum for cost-down.

The number of self running models or bodies may be selected so that the self running models or bodies can participate in a plurality of races enough, and self running models or bodies not participating in a race stand by at stand-by positions. Since the storage batteries of the self running models or bodies not participating in a race can be charged, races can be carried out continuously extending over long time.

The self running models or bodies may be collected in groups for every races, and when it is detected that the storage battery of one of the self running models or bodies belonging to one of the groups is required to be charged with electricity, the storage batteries of all self running models or bodies belonging to the one group may be charged with electricity altogether at the stand-by positions. Since the self running models or bodies belonging to one group is charged with electricity altogether, charge management can be simplified greatly.

Total number of the self running models or bodies may be larger than number of self running models or bodies in a race having most self running models or bodies participating among various races, and the storage battery of a self running model or body requiring charge may be charged at the stand-by position. Since it is possible to charge only a storage battery requiring charge, life of each storage battery can be prolonged to the maximum.

The model may be a boat model. The boat model can be run without necessitating other electric power supply means, and the model driving system can be simplified greatly.

The model may be a race horse model. The race horse model can be run and the model driving system can be simplified greatly.

The present invention provides a game apparatus having a plurality of models moving along a field for gaming, wherein each of said models has a storage battery as electric source for running and self runs along a runway surface, respective connecting sections to a charger are disposed corresponding to said self running models at stand-by positions of said self running models, and said storage battery of said self running model is charged with electricity by said charger automatically in state that said self running model is adjacent to or not separated from said runway surface. Since the model is moved to the stand-by position and the storage battery can be charged at the position, charge is finished in a short time.

The present invention provides a game apparatus having a plurality of models moving along a field for gaming, wherein said model is connected to a crawler self running along a runway surface, said crawler has a storage battery as electric source for running, a charger is disposed at a stand-by position of said running body, and said storage battery of said crawler is charged with electricity by said charger automatically. The storage battery can be charged during the crawler stands by after the game has been over.

A charge condition detecting means for detecting whether the storage battery is required to be charged with electricity or not may be provided and the storage battery on the self running model or body may be charged with electricity by the charger when the charge condition detecting means detects a condition requiring charge. The storage battery can be charged easily by moving the crawler to the charger automatically after the crawler has run.

The present invention provides a game apparatus having a plurality of models running along a predetermined course toward a goal to emulate for order of arrival, wherein a transparent plate is stretched around above of a runway surface on which said models run. When the runway surface is a water surface, water spray accompanying running of the model is prevented from scattering outside, and moreover sight is not obstructed.

BEST MODE FOR CARRYING OUT THE INVENTION

Figure 1:
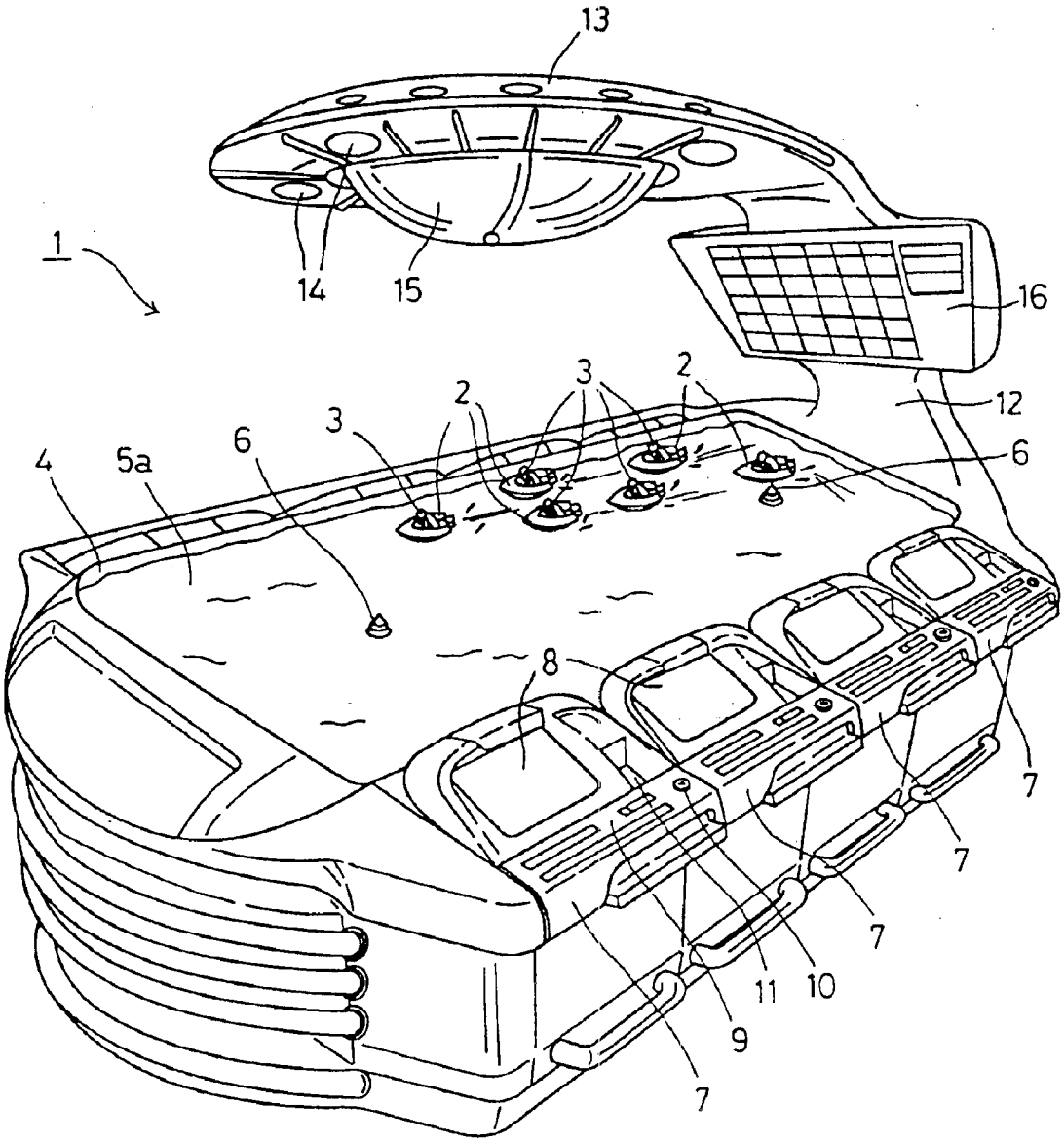
FIG. 1 is an entire perspective view of an embodiment in which the present invention is applied to a boat race game machine.

Hereinafter, an embodiment of the present invention will be described with reference to FIGS. 1 to 21.

In this embodiment, a water tank 4 having length of 330 cm, width of 130 cm and depth of 5 cm is provided at an upper portion of a boat race game machine 1. A motorboat model 2 having length of 8 cm and width of 3.2 cm is connected to a crawler 50 for running on water 5 filling the water tank 4.

FIG. 1 shows the boat race game machine 1 using the motorboat models 2 as ship models. A racer model 3 is on board each of the motorboat models 2. A rectangular water tank (liquid tank) 4 is filled with water (liquid) 5 to simulate a boat race course. At positions near lengthwise both ends and in the middle of breadth of the water tank 4 are disposed turn marks 6. The positions of the turn marks 6 are adjustable.

On each side of the water tank 4 corresponding to the stand position are disposed four satellite 7. Each satellite 7 has a display section 8, a operating panel 9, a coin slot 10 and a coin return 11. Players can vote an expected winning boat by single or plural voting by manipulating the operating panel 9.

As shown in FIG. 1, the boat race game machine 1 has a ceiling 13 formed at an upper end of a support section 12 directed obliquely upward from an end of the water tank 4. On a lower surface of the ceiling 13 are arranged loudspeakers 14 and a lighting apparatus 15. On a surface of the support section 12 facing the water tank 4 is disposed a display 16 to display presentation of the racer models 3, boat numbers, frame numbers bet rates and the like.

Figure 2:
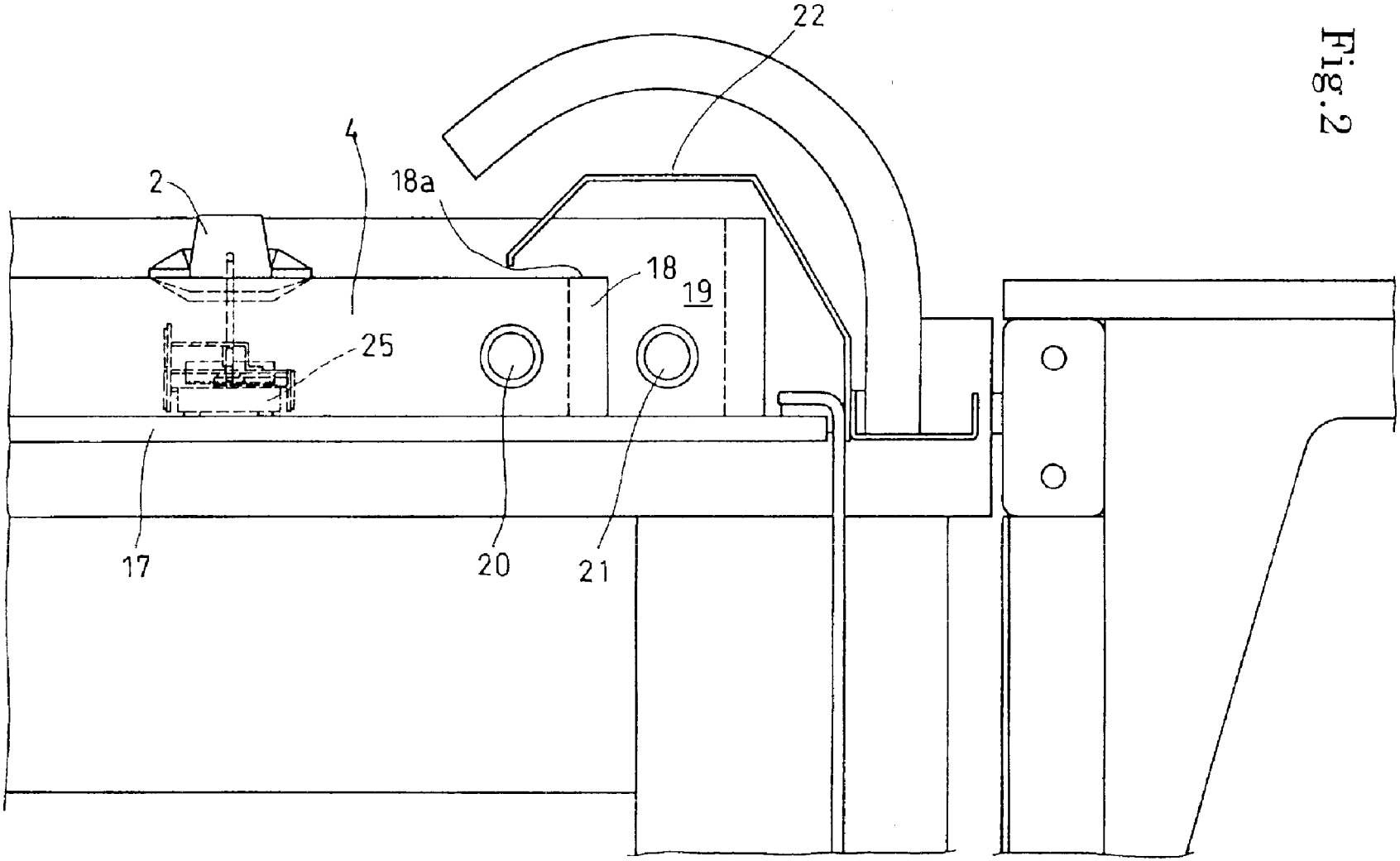
FIG. 2 is an enlarged side view of an essential part of a water tank in the boat race game machine.
Figure 3:
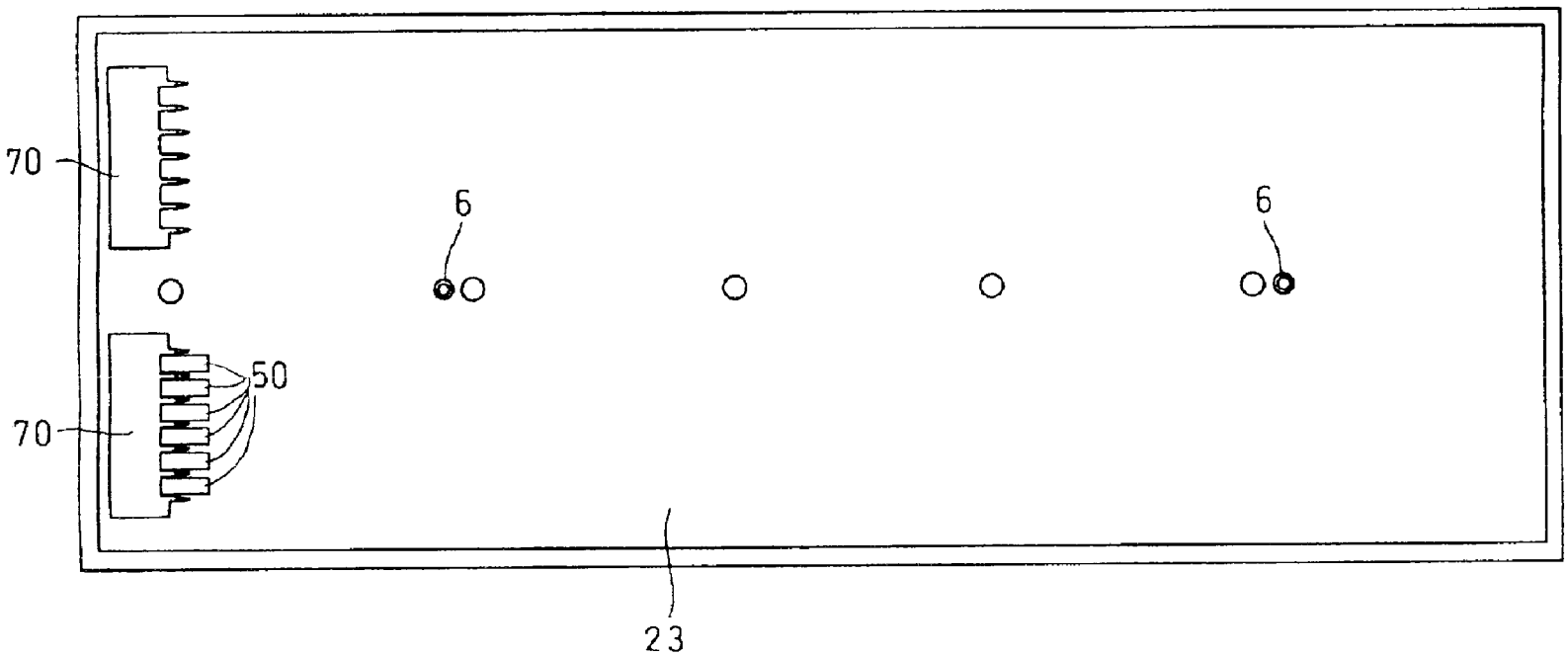
FIG. 3 is a plan view of the boat race game machine from which a runway plate is removed.

As shown in FIG. 2, a runway plate 17 having thickness of about 1 cm is laid at the bottom of the water tank 4. On an upper surface of the runway plate 17 is laid a hologram sheet that changes light and shade according to seeing direction. A metal such as silver or gold is plated on a lower surface of the hologram sheet by evaporation. A side wall 18 having a horizontal upper edge 18*a* is elected vertically on an outer peripheral edge of the runway plate 17. The upper edge 18*a* sets a water level of about 1 cm of the water tank 4. Water exceeding the set level spills into a drainage 19 surrounding the side wall 18. A water outlet 21 of the drainage 19 and a water inlet 20 of the water tank 4 communicate with each other through a pump (not shown). When the water level 5*a* of the water tank 4 becomes lower than the upper edge 18*a* of the side wall 18, the pump comes into operation in accordance with a detection signal of a level sensor (not shown), so that water 5 in the drainage 19 is sucked through the water outlet 21 and delivered into the water tank 4 through the water inlet 20 to make the water level coincide with the upper edge 18*a*. The water inlet 20, the pump and the level sensor constitute a liquid supplement means.

Figure 4:
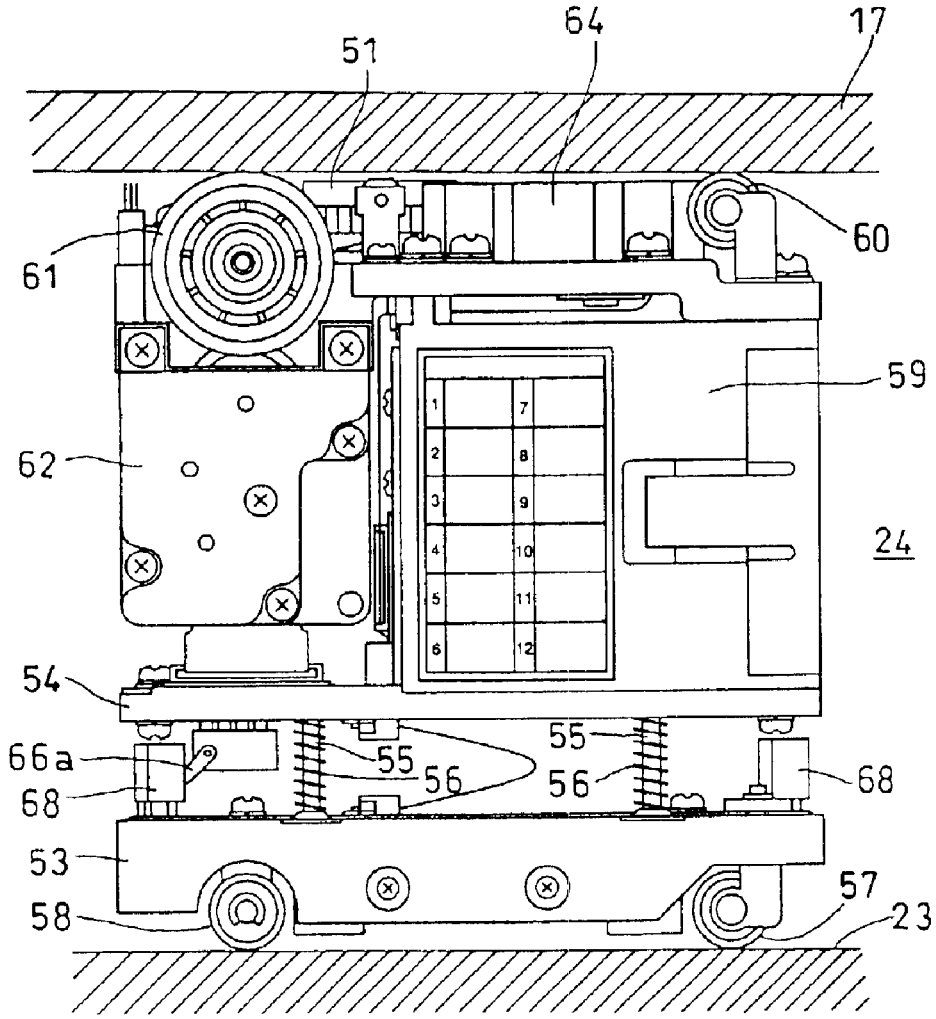
FIG. 4 is a side view of a running body.
Figure 5:
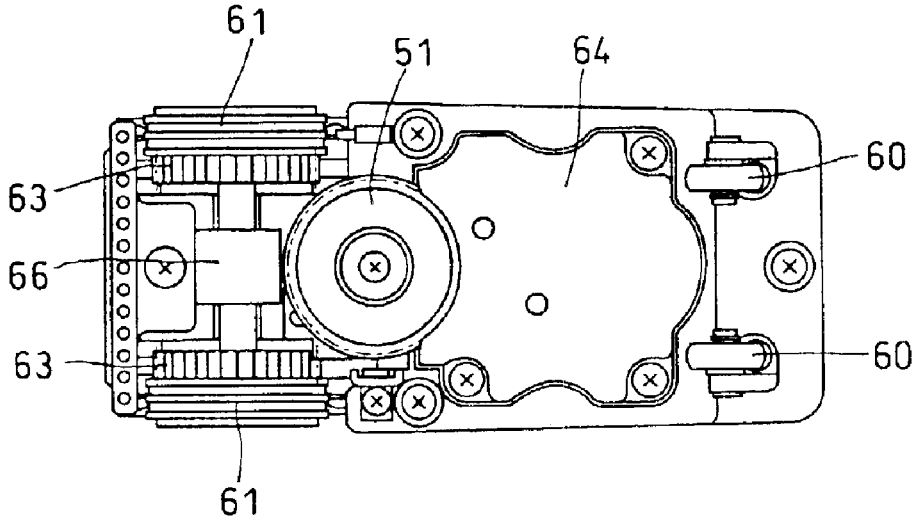
FIG. 5 is a plan view of the running body.

Above the upper edge 18*a* of the side wall 18 is disposed a water drop scatter preventing member 22 at a predetermined distance. As shown in FIG. 4, under the runway plate 17 is formed a supporting surface 23 by a flat plate or a foundation at a predetermined distance substantially in parallel with a lower surface of the runway plate 17. Also an outer peripheral of the supporting surface 23 is surrounded by a side wall (not shown) to form a closed space 24 between the runway plate 17 and the supporting surface 23.

Figure 9:
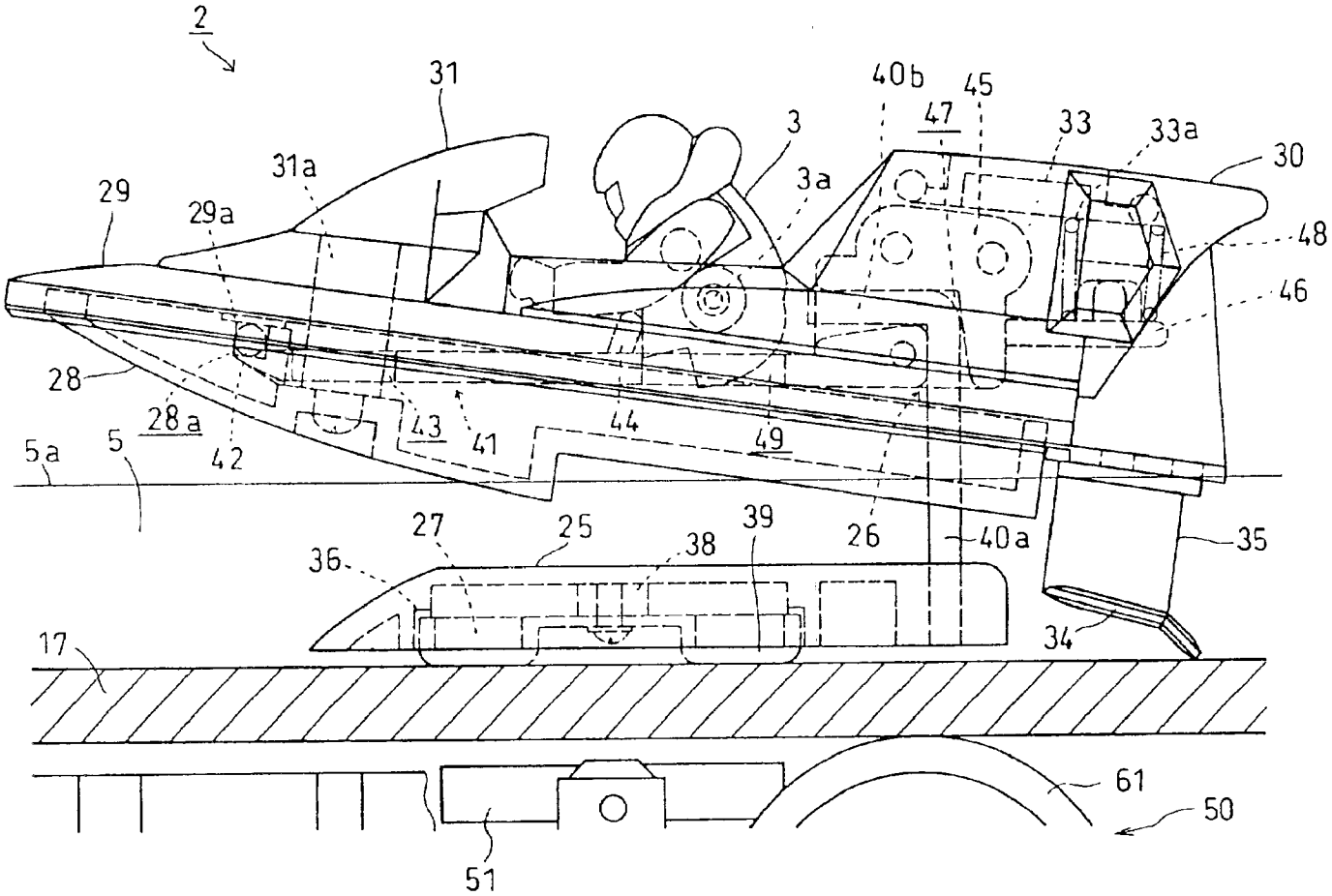
FIG. 9 is a side view of a motorboat model and a towing body.
Figure 10:
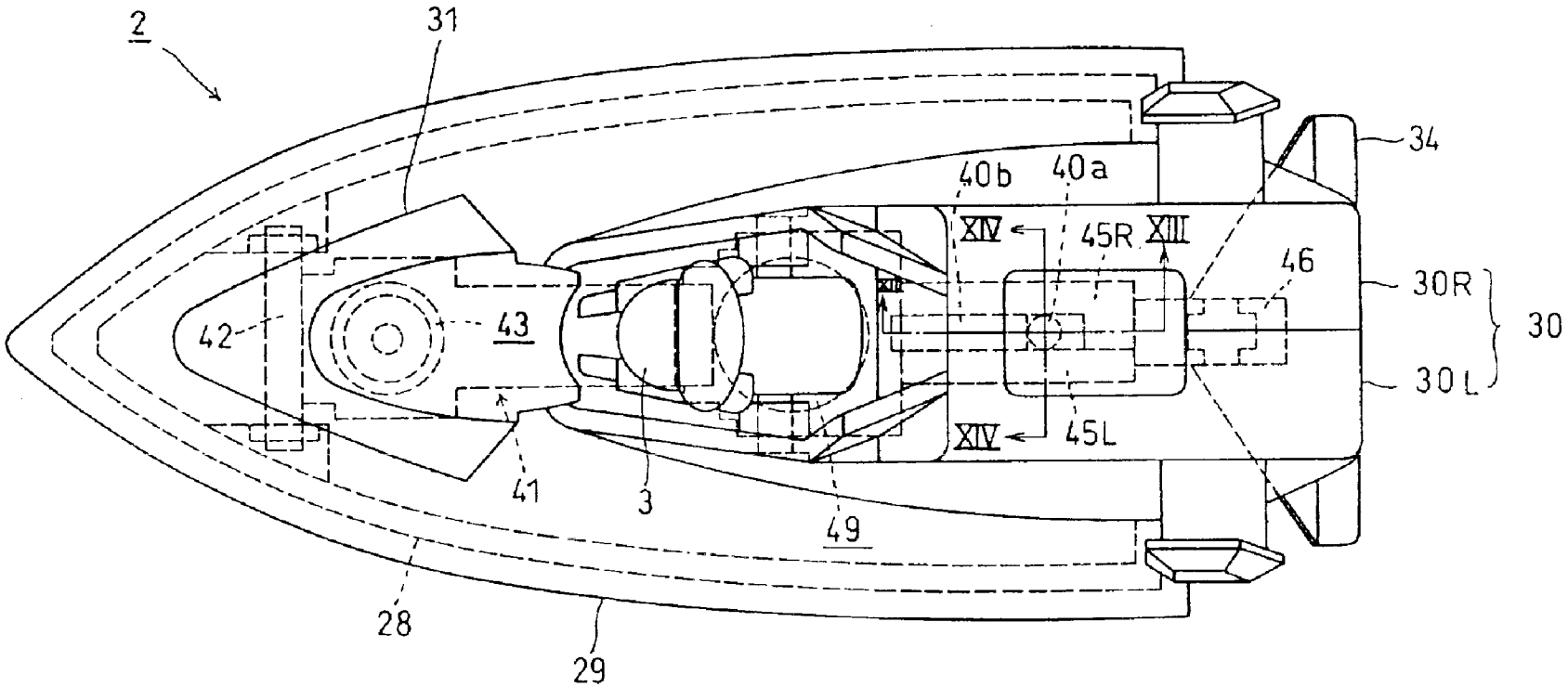
FIG. 10 is a plan view of FIG. 9.
Figure 15:
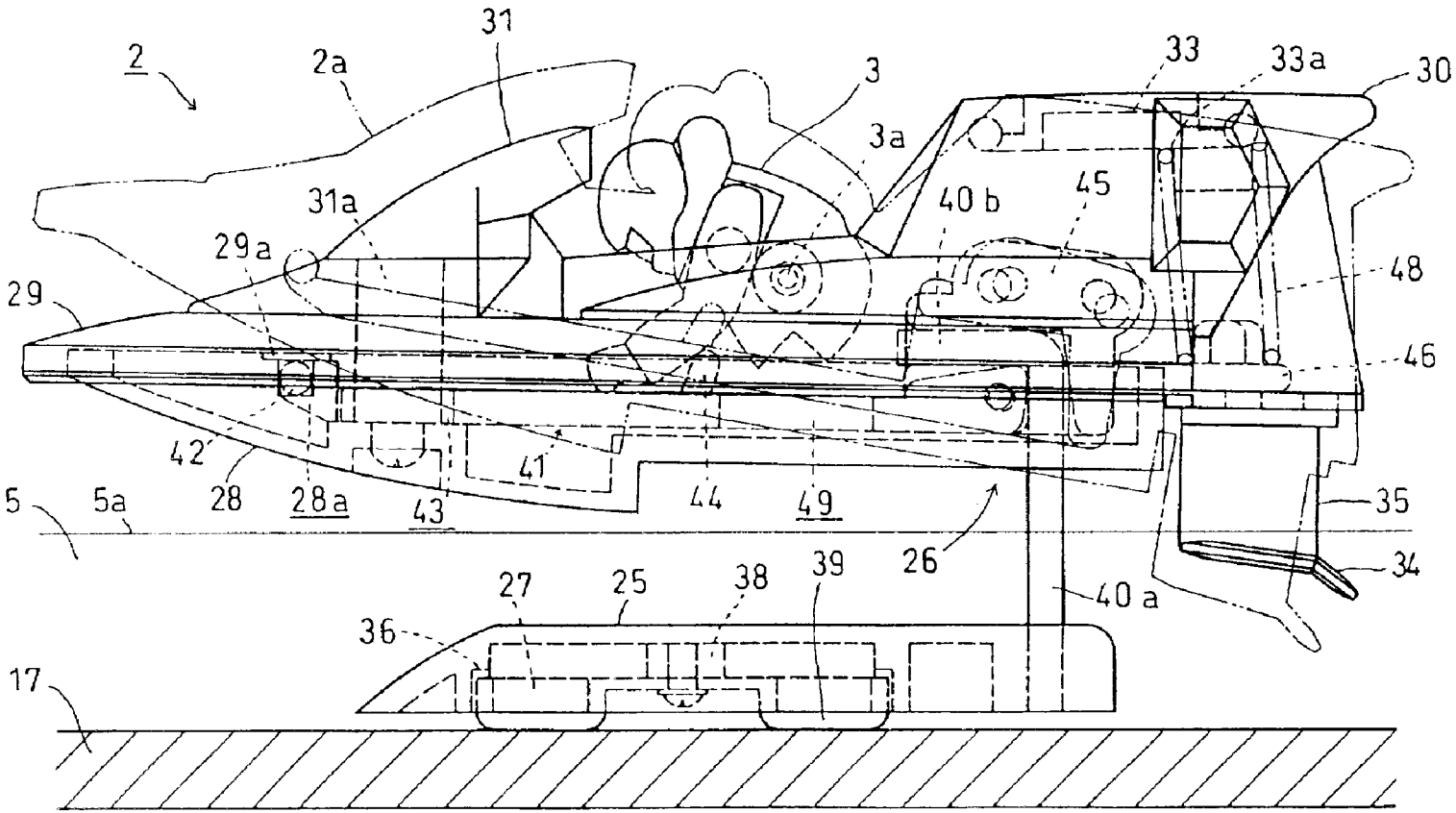
FIG. 15 is a side view of the motorboat model and the towing body showing a state that the motorboat model is lifted up.
Figure 16:
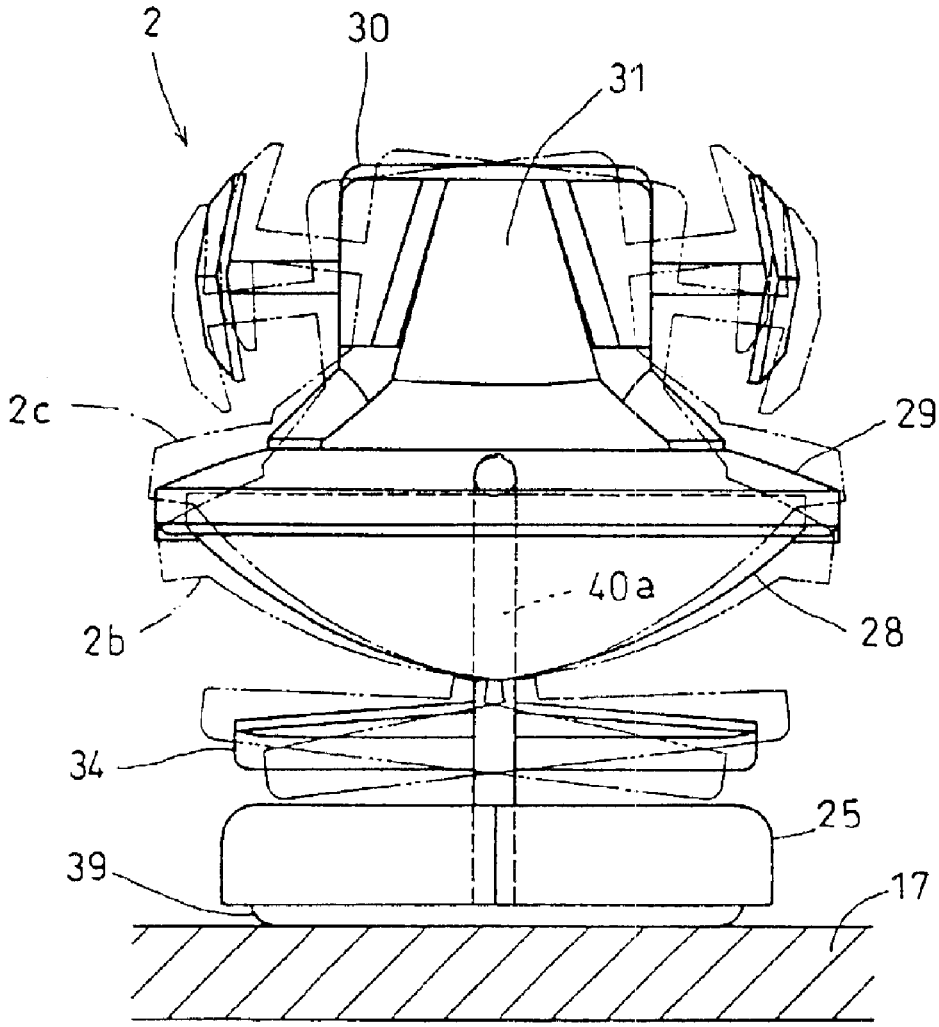
FIG. 16 is a front view of the motorboat model and the towing body in running state.
Figure 17:
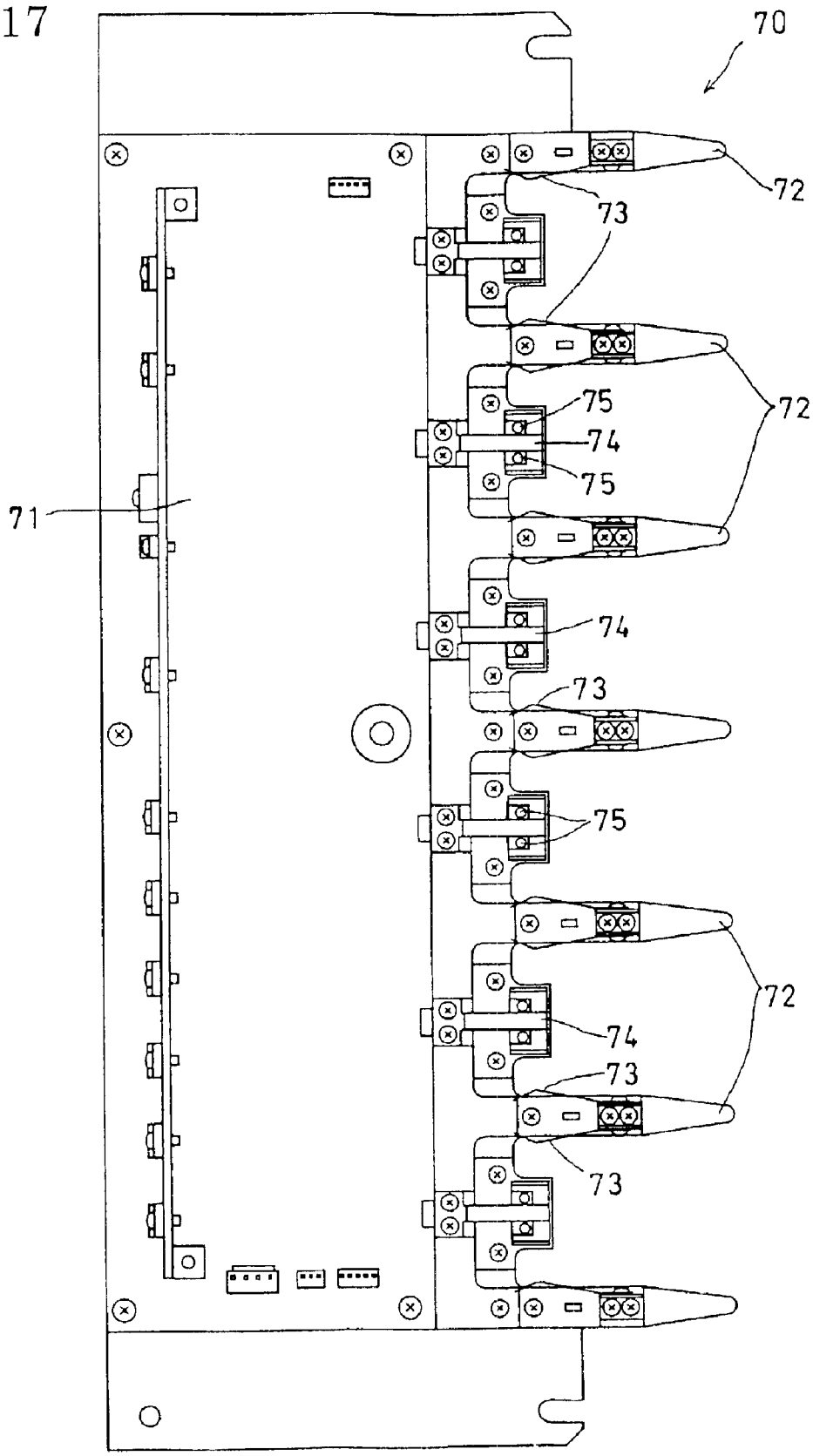
FIG. 17 is an entire plan view of a charge apparatus.
Figure 18:
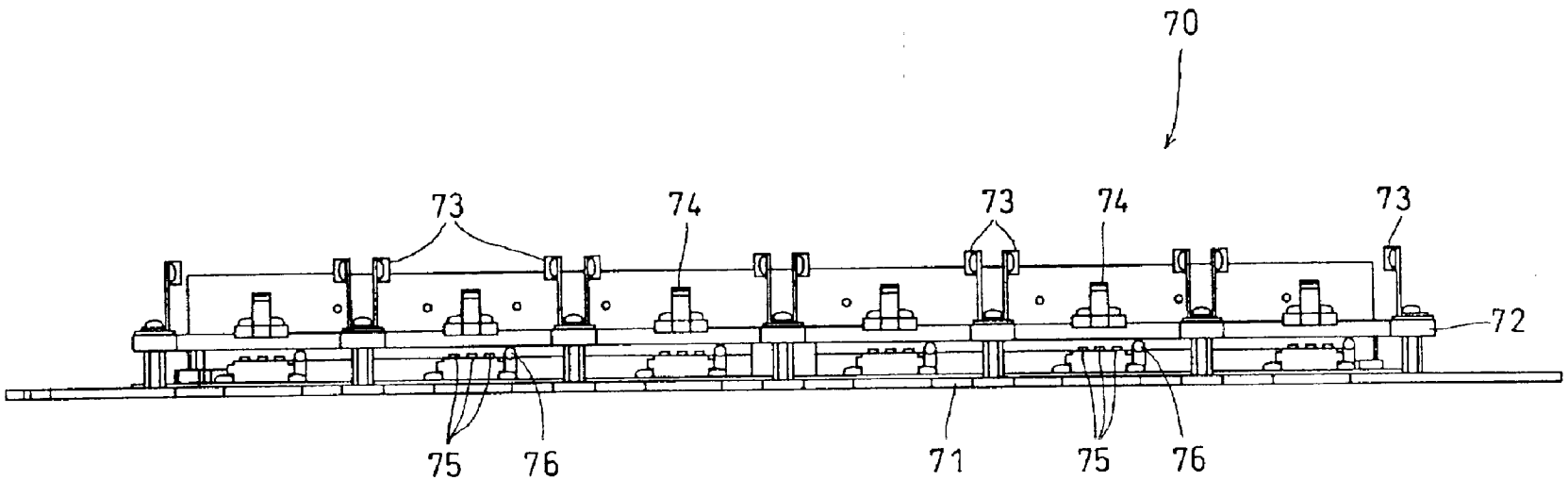
FIG. 18 is an entire front view of the charge apparatus.
Figure 19:
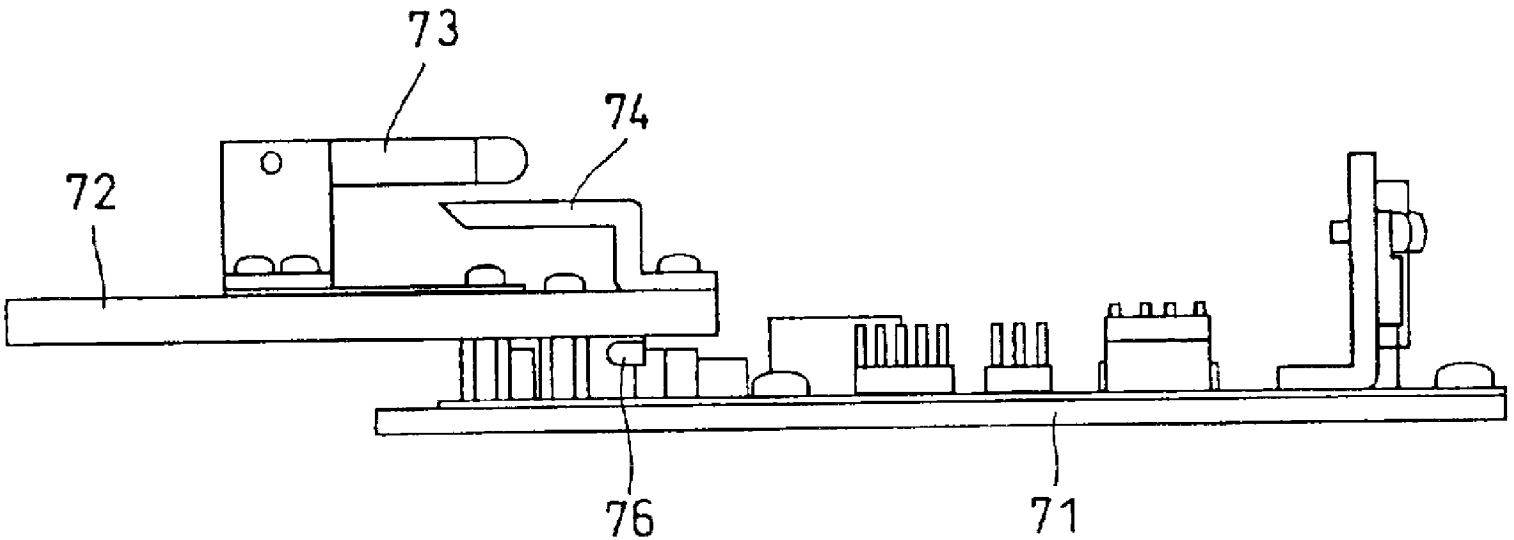
FIG. 19 is an entire side view of the charge apparatus.
Figure 20:
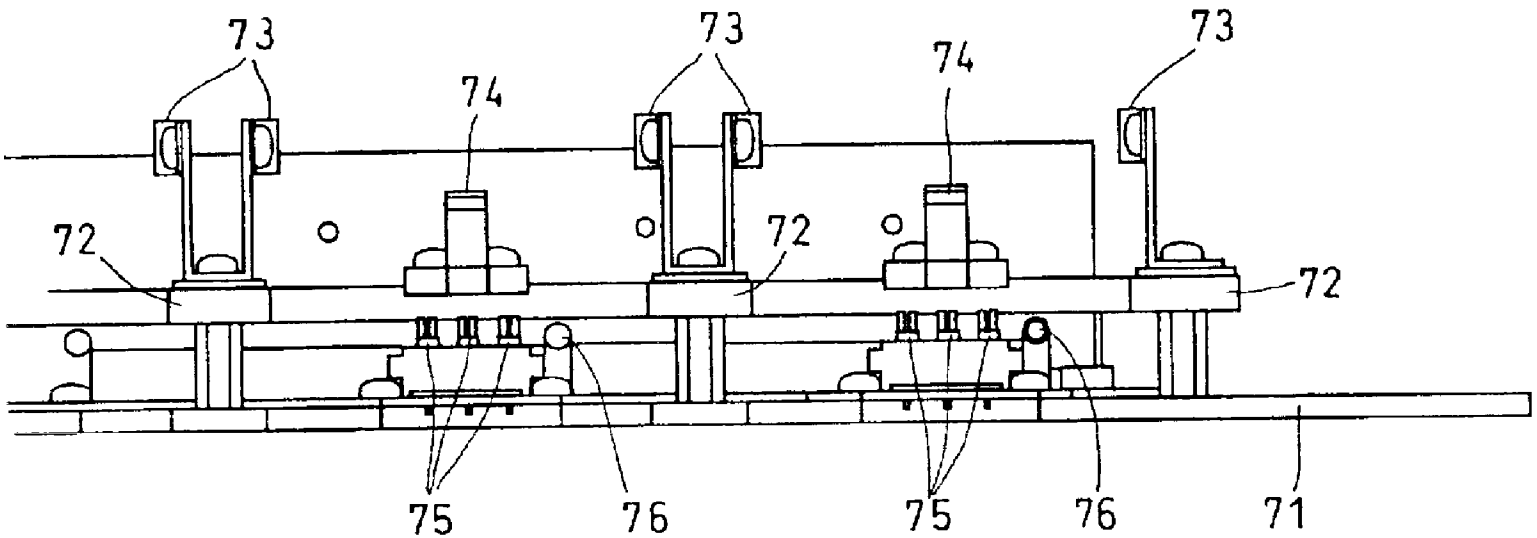
FIG. 20 is a partial enlarged front view of FIG. 18.

As shown in FIGS. 9 and 15, the model comprises the motorboat model 2 having length of about 8 cm, width of about 3.2 cm and height of about 3.5 cm, a towing body 25 and a connecting means 26. The towing body 25 is made of transparent plastics and put on the runway plate 17 in the water tank 4, and the motorboat model 2 and the towing body 25 are connected with each other through the connecting means 26.

In the closed space 24 is disposed a crawler 50 as a driving source of the towing body 26. On the towing body 25 is disposed a permanent magnet 27 as a towing body side magnetic connection member, and on a top of the crawler 50 is disposed a permanent magnet 51 as a running body side magnetic connection member at a position corresponding to the magnet 27. Polarity of lower side of the permanent magnet 27 and polarity of upper side of the permanent magnet 51 are different from each other, so that the towing body 25 and the crawler 50 are connected with each other by magnetic attraction acting between the permanent magnets 27, 51, and the towing body runs on the runway plate 17 following the crawler 50.

As shown in FIGS. 9 to 16, the motorboat model 2 comprises a hull 28 and a deck 29 connected with each other, and a housing 30 and a windshield 31 are attached to the deck 29. The housing 30 comprises a right housing half 30R and a left housing half 30L connected to each other by pressing. Between front portions of the both housing halves 30R, 30L is supported a racer model 3 so as to rotate about a support shaft 3*a* extending transversely. Between rear portions of the both housing halves 30R, 30L is fixed a boat number display member 33. The windshield 31 is fixed to the hull 28 and the deck 29 by an attachment shaft 31*a* penetrating a hole of the deck 29 and screwed to the hull 28.

On a lower surface of a rear end portion of the deck 29 is provided a lift blade 34 immersed in the water. The lift blade 34 is fixed to the deck 29 through a support plate 35. The lift blade 34 and the support plate 35 are formed integrally with transparent plastics. The lift blade 34 is shaped in a triangle and has a rear edge inclined downward largely to generate lift.

The permanent magnet 27 is housed in a columnar recess 36 formed on a lower surface of the towing body 25 of the transparent plastics running on the runway plate 17 in the water tank. The permanent magnet 27 is held so as not to rotate by a holding shaft 38 formed integrally with the towing body at a center of the recess 36. A front end portion of the towing body 25 has thickness gradually increasing rearward, and a portion of the towing body 25 corresponding to the permanent magnet 27 is formed in a thin flat shape.

A lower surface side of the permanent magnet 27 is covered with a cover 39 made of plastics having a low coefficient of friction, for example 4 ethylene fluoride resin. The cover 39 is screwed to the holding shaft 38 so that the permanent magnet 27 can not move axially and circumferentially relatively to the holding shaft 38. Thus the cover 39 is fixed to the towing body 25.

The cover 39 projects from the lower surface of the towing body 25 by a predetermined amount to act as a glide member. Since the cover 39 and the running plate 17 come into contact with each other in a low frictional state, the towing body 25 can glide along the runway plate 17.

Figure 11:
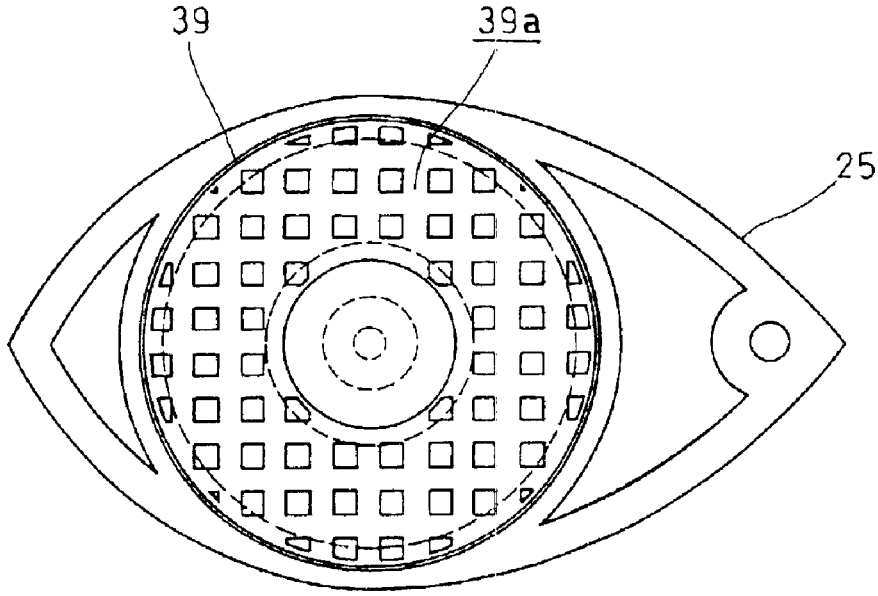
FIG. 11 is a plan view of the towing body.
Figure 12:
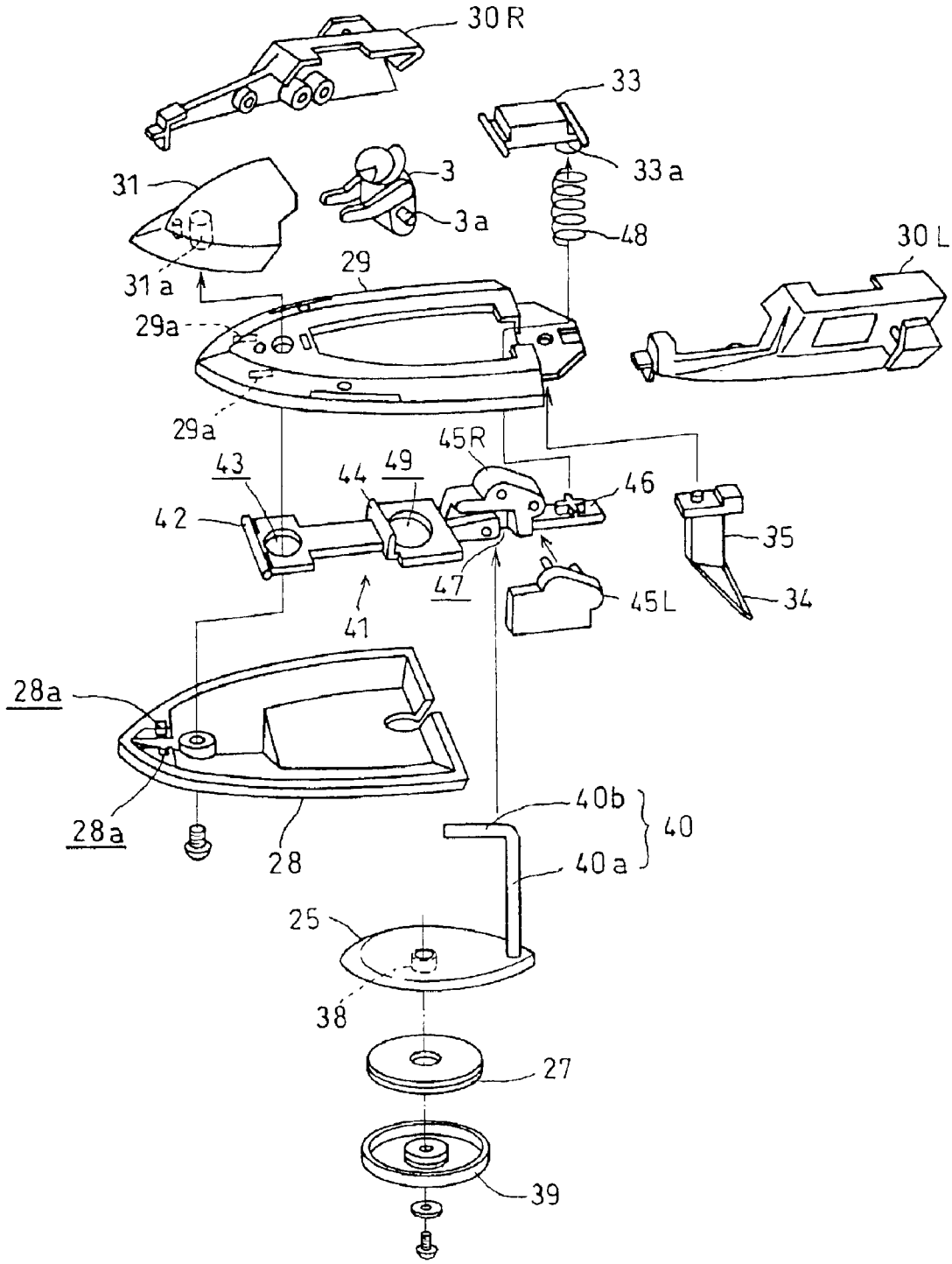
FIG. 12 is an exploded perspective view of the motorboat model, a racer model and the towing body.
Figure 13:
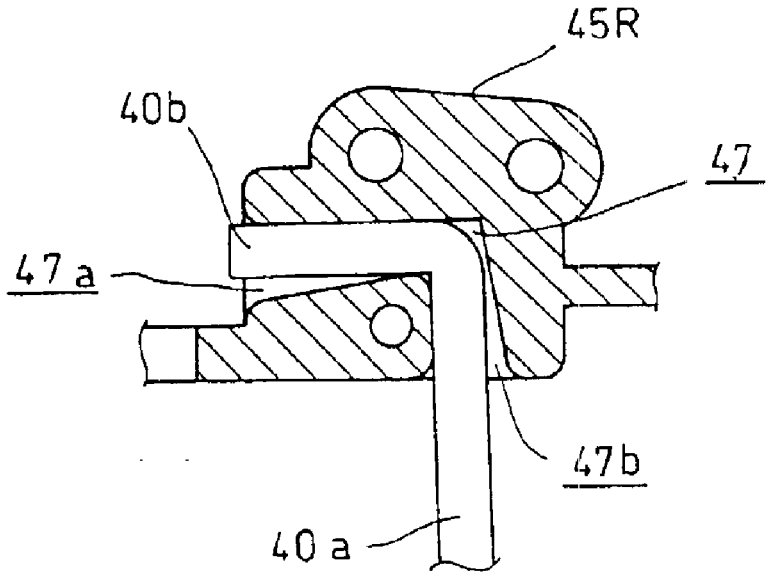
FIG. 13 is a longitudinal sectional view taken along the line XIII—XIII of FIG. 10.
Figure 14:
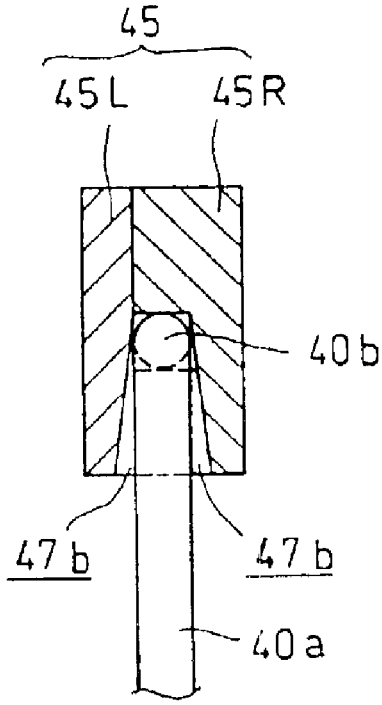
FIG. 14 is a cross sectional view taken along the line XIV—XIV of FIG. 10.

As shown in FIG. 11, on the lower surface of the cover 39 touching the runway plate 17 are formed lattice-like grooves 39*a*. The grooves 39*a* allow that a slight amount of water 5 flows in and flows out between a lower surface of the caver 39 and an upper surface of the runway plate 17 to prevent the cover 39 from adhering to the runway plate 17. Therefore, smooth running of the towing body 25 is not obstructed. Width and depth of the groove 39*a* is to be determined properly by experiments.

The connecting means connecting the towing body 25 with the motorboat model 2 comprises a boat supporting shaft 40 and a support member 41. In the state that the motorboat model 2 and the towing body 25 are connected with each other, the front end of the motorboat model 2 is positioned in front of the front end of the towing body 25.

The L-shaped boat supporting shaft 40 has a base part 40*a* extending vertically upward from the towing body 25 and an upper bent part 40*b* bent forward at right angles with the base part 40*a*. The lower end of the base part 40*a* is fixed to a rear part of the towing body 25.

The support member 41 is disposed in a space formed between the hull 28 and the deck 29 of the motorboat model 2 and pivoted at a pivoting section positioned at a front part of the hull 28. The support member 41 has a pivot 42, a circular hole 43 through which an attachment shaft 31*a* of the windshield 31 penetrates with a gap so as to allow relative rotation of the support member 41 and the motorboat model 2, a racer model operating section (crew model control means) 44 for controlling action of the racer model 3, a block 45 to which an upper end of the base part 40*a* and the bent part 40*b* of the boat supporting shaft 40 are fitted, and a spring bearing 46 disposed in order from front to rear.

The above-mentioned pivoting section is composed of grooves 28*a* formed in a pair of right and left projections provided at a front part of the hull 28 for housing both ends of the pivot 42, and a pair of projections 29*a* formed on a lower surface of the deck 29 corresponding to the grooves 28*a* for preventing the pivot 42 from coming out of the grooves 28*a*. Therefore, the motorboat model 2 can rotate about the transversal axis of the pivot 42, namely can incline in the longitudinal direction, relatively to the support member 41.

The block 45 is constructed from a right block half 45R formed integrally with the support member 41 and a left block half 45L press-connected to the right block half 45R. The block halves 45R, 45L have grooves forming an engagement hole 47 for housing an upper end of the base part 40*a* and the bent part 40*b* of the boat supporting shaft 40. Between the engagement hole 47 and the boat supporting shaft 40 are formed a gap 47*a* (FIG. 13) in the direction of the pitching motion and a gap 47*b* (FIG. 14) in the direction of the rolling motion, so that when the boat supporting shaft 40 is engaged with the engagement hole 47 and the motorboat model 2 and the support member 41 are integrated with each other by lift acting of the lift blade 34 as will be mentioned later, the motorboat model 2 can rotate about a transversal axis in a predetermined extent relatively to the boat supporting shaft 40 for carrying out the pitching motion, and also can rotate about a longitudinal axis in a predetermined extent for carrying out the rolling motion.

The racer model operating section 44 is composed of a projection coming into contact with the racer model 3 which can rotate relatively to the housing 30. In accordance with rotation of the motorboat model 2 relative to the support member 41, the racer model operating section 44 touches the racer model 3 to let the racer model 3 have a non-handling posture (FIG. 9) and a handling posture (FIG. 15). For that purpose, the racer model operating section 44 touches the racer model 3 at a position in front of the center of rotation of the racer model 3 defined by the support shaft 3*a*, and the center of gravity of the racer model 3 is positioned in front of the center of rotation always so that the racer model 3 touches the racer model operating section 44 always.

Between the spring bearing 46 at a rear end part of the support member 41 and a spring bearing 33*a* provided on a lower surface of the boat number display member 33 fixed to the housing 30, a coil spring 48 is fitted in a compressed condition. When the motorboat model 2 is substantially horizontal (FIG. 15), the coil spring 48 generates a counterclockwise moment smaller than a clockwise moment about the pivot 42 caused by own weight of the motorboat model 2. Therefore, on running of the motorboat model 2, if the lift acting on the lift blade 34 increases to produce a counterclockwise moment overcoming a difference between the clockwise moment by own weight of the motorboat model 2 and the counterclockwise moment by the coil spring 48, the motorboat model 2 is rotated about the pivot 42 relatively to the support member 41 so that the motorboat model 2 can be kept substantially in a horizontal posture as shown in FIG. 15.

When the motorboat model 2 is stopped, the coil spring 48 is compressed by the own weight of the motorboat model 2 until the lift blade 34 touches the runway plate 17 and rotation of the motorboat model 2 relative to the support member 41 is limited. Thus, the motorboat model 2 takes an inclined position as shown in FIG. 9 at which the racer model operating section 44 touches the arm of the racer model 3 to let the racer model 3 have the non-handling posture. When the racer model 3 has the non-handling posture, a part of the racer model 3 is housed in a circular hole 49 formed between the racer model operating section 44 and the block 45.

The coil spring 48 acts so as to promote the counterclockwise rotation of the motorboat model 2 owing to the lift acting on the lift blade 34. Therefore, even at a running speed in a degree of that of the motorboat model 2 running on the water surface 5*a* of the water tank, the lift acting on the lift blade 34 can rotate the motorboat model 2 counterclockwise about the pivot 42 relatively to the support member 41.

When the lift has been increased sufficiently, as shown in FIG. 15, the rear end of the deck 29 touches the rear end of the support member 41 to limit the counterclockwise rotation of the motorboat model 2 relative to the support member 41 and bring the motorboat model 2 into a substantially horizontal state. The motorboat model 2 and the support member 41 move in one body and the racer model 3 is rotated counterclockwise by the racer model operating section 44 to have the handling posture.

Next, the crawler 50 will be described with reference to FIGS. 4 to 8.

The crawler 50 (length: about 10 cm, width: about 4.5 cm, height: about 12 cm) is divided into a carriage 53 and an elevating table 54. The carriage 53 as a main of the running body has elevating guide shafts 55 provided vertically at the four corners thereof. Forcing coil springs 56 as forcing means are fitted to the respective elevating guide shafts and the elevating table 54 is fitted to the guide shafts 55 from their upper ends so as to rise and fall. Thus, the elevating table 54 is forced by the coil spring 56 upward, that is, toward the lower surface of the runway plate 17. Therefore, a necessary frictional force acts between a rear running wheel 61 and a lower surface of the runway plate 17 so that the crawler 50 can run with a necessary driving force. The forcing spring 56 generates a predetermined spring force with a small spring constant so that change of the spring force forcing the elevating table 54 is little when the distance between the lower surface of the runway plate 17 and the supporting surface 23 is changed.

A front caster 57 is provided on a front lower surface of the carriage 53 so as to turn freely about a vertical axis, a rear wheel 58 is provided on a rear lower surface of the carriage 53 and a lithium ion battery 59 is mounted on a front upper surface of the carriage 53 detachably laterally. The lithium ion battery has a protection circuit preventing abnormally large electric current flowing through the main of the battery.

A front running caster 60 is provided on a front upper surface of the elevating table 54 so as to turn freely about a vertical axis, a pair of right and left running wheels 61 (driving wheels) is provided on a rear upper surface of the elevating table 54 and a pair of right and left running motors 62 is provided under the running wheels 61. Rotary shafts of the running motors 62 and rotary shafts of the rear running wheels 61 are connected through reduction gear mechanisms 63 (partly shown in FIG. 5), respectively, so that the rear running wheel 61 is driven by the running motor 62. The crawler 50 can be run in a required direction by difference of rotational speeds of the right and left running motors 62.

A boat rotating motor 64 is disposed on the elevating table positioned between the permanent magnets 51 and the front running caster 60. The boat rotating motor 64 is connected to the permanent magnet 51 through a reduction gear mechanism (not shown) so that the permanent magnet supported on the elevating table 54 is driven to rotate by the boat rotating motor 64.

When the permanent magnet 51 is rotated by the boat rotating motor 64, the permanent magnet 27 is rotated by the magnetic attraction, and the motorboat model 2 is rotated relatively to the towing body 25 and the crawler 50 through the towing body 25, the boat supporting shaft 40, the block 45, the hull 28 and the deck 25.

Figure 6:
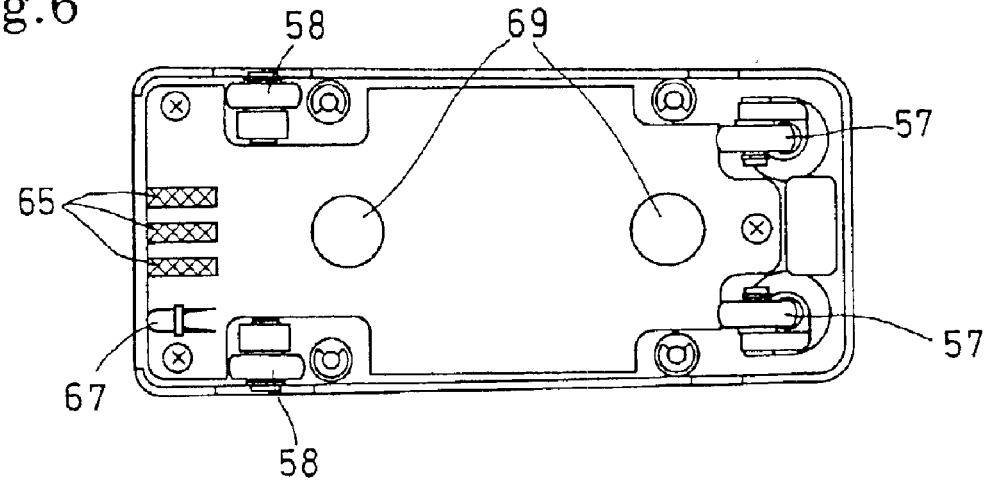
FIG. 6 is a bottom view of the running body.
Figure 7:
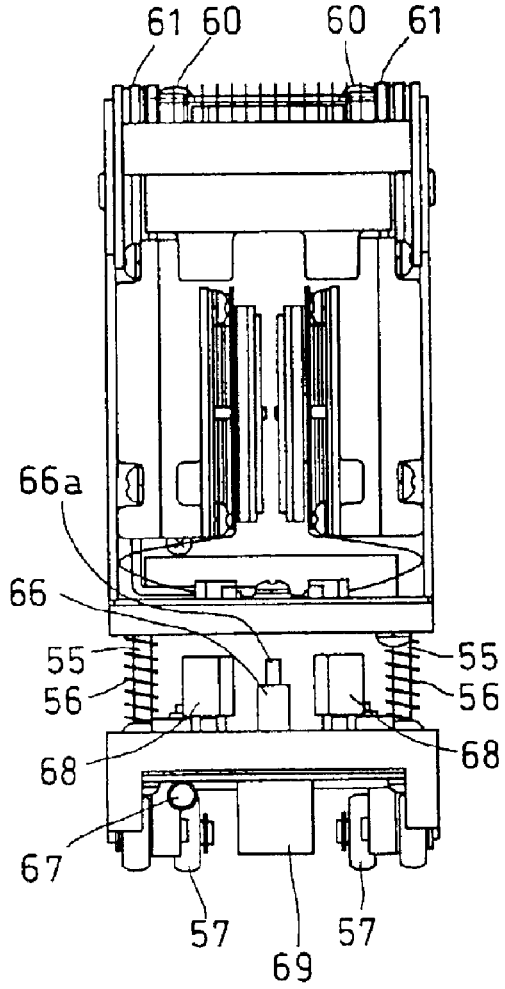
FIG. 7 is a rear view of the running body.
Figure 8:
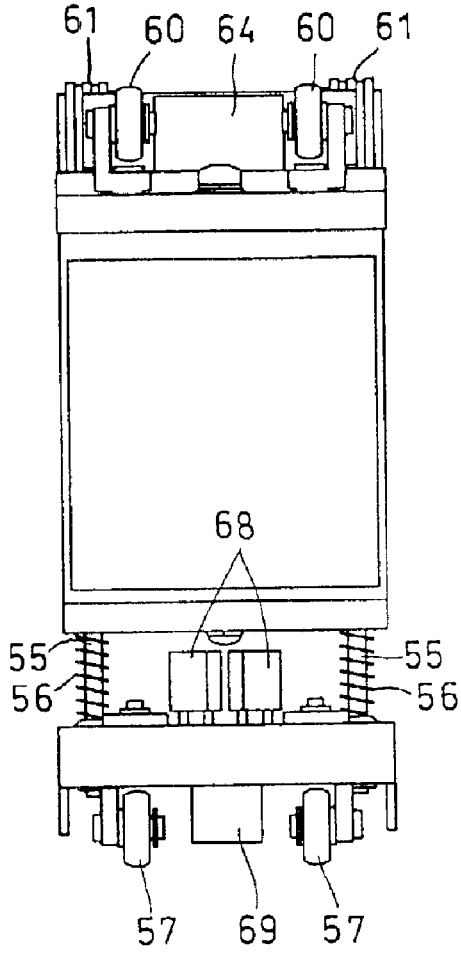
FIG. 8 is a front view of the running body.

On a lower surface of a rear end of the carriage 53 are provided three charge terminals 65 as shown in FIG. 6, and on an upper surface of a rear end of the carriage 53 positioned above the terminals 65 is provided a b-contact electric source switch 66. In the neighborhood of the charge terminals 65 is provided an infrared ray transmitter-receiver 67 transmitting charge condition of the lithium ion battery 59, and positioned at four corners of the carriage 53 are provided infrared receivers 68 receiving running control signal from a LED 86 to be described later. Further, oscillation coils 69 transmitting position of the crawler 50 are provided at front and rear.

One of the charge terminals 65 is a positive terminal to add charge voltage to the lithium ion battery for supplying charge current, another charge terminal is a signal transmitting terminal for transmitting data of charge condition of the lithium ion battery 59 to a charging apparatus 70, and further charge terminal is an earth terminal for the positive terminal and the signal transmitting terminal.

Next, the charging apparatus 70 disposed at an end (left end in FIG. 3) of the supporting surface 23 will be described.

As shown in FIG. 3 and FIGS. 17 to 21, in front of a base plate 71 (right side in FIGS. 3, 17) are projected seven guide pieces 72 having slight distance from both sides of the crawler 50. Each guide piece 72 has guide plate springs or a guide plate spring 73 to hold the crawler 50 loosely fitted between neighboring guide pieces 72 for stand-by.

At a middle position between base parts of the neighboring guide pieces 72 is provided a striker 74 for turning off the electric source switch 66. Under the striker 74 are provided three connection terminals 75 which can be connected with the charge terminals 65 respectively. In the neighborhood of the connection terminals 75 is provided a infrared ray transmitter-receiver 76 for receiving charge condition signal of the infrared ray transmitter-receiver 67.

Figure 21:
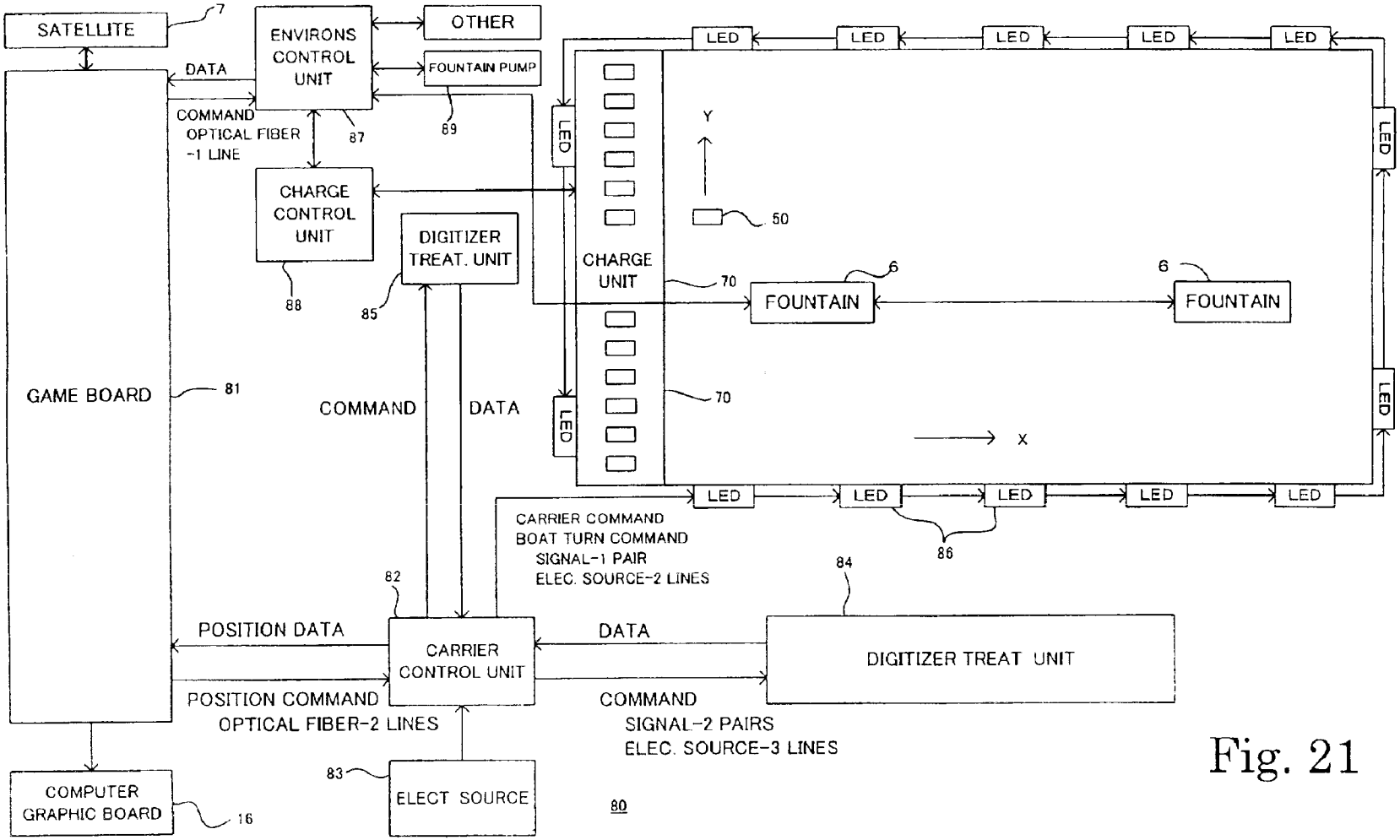
FIG. 21 is a control block diagram of the whole boat race game machine.

A control apparatus 80 of the boat game race machine 1 will be described with reference to FIG. 21.

Within the main of the boat race game machine 1, under the runway plate 17 are disposed a game board 81, a carrier control unit 82, an electric source 83, a digitizer treatment unit 84, a position detecting digitizer treatment unit 85, an environs control unit 87, a charge control unit 88 and a fountain pump 89. Information of medals put in and information of votes to the motorboat models 2 are inputted to the game board 81 from the satellite 7 outside of the main of the boat race game machine 1, and information of allotment after the game finished is outputted from the game board 81 to the satellite 7.

Enlarged picture information of competing six motorboat models 2 is transmitted to the display 16 on the basis of position information of the motorboat models 2 calculated by the game board 81. Further, information of magnification according to result of the votes and information of allotment after the game finished are also transmitted to the display 16.

In the game board 81, odds are calculated on the basis of times and orders of arrival of each racer model 3 in various weather conditions such as wind and wave in the past, and order of arrival of each motorboat model 2 is previously decided with probability corresponding to the odds.

Position data of the motorboat models 2 at a time when a predetermined time elapses after the motorboat models 2 started is calculated in the game board 81, and the calculated position data are transmitted to the carrier control unit 82 from the game board 81, so that the motorboat models 2 pass through a start line at the same time. Detected position data of the motorboat models 2 at that time is transmitted to the game board 81 from the carrier control unit 82. The calculated position data and the detected position data are transmitted successively at regular intervals until the motorboat models 2 reach the start line.

After that, position data of the motorboat models after the motorboat models 2 passed through the start line are calculated in the game board 81 successively corresponding to characters of the motorboat models 2, ahead type or last spurt type for example, and the calculated position data are transmitted to the carrier control unit from the game board so that the motorboat models 2 arrive at a goal with the predetermined orders.

Within the closed space 24, on the supporting surface 23 are stretched electric wires in longitudinal direction X and transversal direction Y in shape of lattice. Position signals of X and Y directions transmitted from the oscillator coil 69 of the crawler 50 are received by the digitizer treatment units 84, 85 of X and Y directions through the lattice-like electric wires and then transmitted to the game board 81 through the carrier control unit 82.

Position command data are transmitted from the game board 81 to the carrier control unit 82 so that there is no discrepancy between a present set position of a motorboat model 2 or a crawler 50 and a present detected position thereof transmitted from the digitizer treatment units 84, 85. The carrier control unit 82 transmits a command signal for a crawler 50 to LED 86. LED 86 transmits a infrared ray carrier command and a turning command signal for drifting the motorboat model 2.

Calculated position data of the motorboat models 2 or the self running bodies 50 transmitted to the carrier control unit are transmitted from LED 86 as infrared ray signals into the closed space 24 serially. Each crawler 50 selects and receives only its own calculated position data and rotates its right and left rear running wheels 61 with respective required rotational speeds to run to a required calculated position.

Command signals for controlling charge, fountain and the like are transmitted from the game board 81 to the environ control unit 87. Data of charge, fountain and the like are transmitted from the environ control unit 87 to the game board 81. Thus operations of the fountain pump 89 and the turn mark 6 are controlled.

Commands and data are exchanged between the charge control unit 88 and the environ control unit 87 to carry out charge of the lithium ion battery 59 mounted on the crawler.

The game board 81 transmits running signals to LED 86 through the carrier control unit 82 so that the motorboat models 2 (self running bodies 50) return to the stand-by positions at an end (left end in FIGS. 3, 21) of the boat race game machine 1 after a game has been finished.

According to running control signal transmitted to the crawler 50 from the game board 81 through the carrier control unit 82 and the LED 86, the crawler returning to the standby position advances between the guide pieces 72 of the charge apparatus 70 and stops when the charge terminal 65 of the crawler 50 approaches the connection terminals 75 of the charge apparatus 70. At this stop position, remaining electricity of the lithium ion battery 59 mounted on the crawler 50 is transmitted from the infrared ray transmitter-receiver 67 of the crawler 50 to the infrared ray transmitter-receiver 76 of the charge apparatus as infrared ray signal. When the remaining electricity of the lithium ion battery 59 is more than 30%, charging is unnecessary, therefore the crawler 50 merely stands by.

When the remaining electricity of the lithium ion battery is less than 30%, charging is necessary and therefore six motorboat models 2 of another group participate in the next race.

When charging is necessary as above, the crawler 50 further goes back toward the charge apparatus 70. And when the charge terminals 65 of the crawler 50 are connected with the, corresponding connection terminals 75 of the charge apparatus 75 and a lever 66*a* of the electric source switch 66 of the crawler 50 is pressed by the striker 74 of the charge apparatus 70 to turn off the electric source switch, the crawler 50 is stopped.

In the charging state, data such as remaining electricity, battery terminal voltage and battery temperature in the lithium ion battery 59 are transmitted to the charge control unit 88 through the charge terminals 65 and the connection terminals 75. Based on the charging data, charge voltage is added to the electrode of the lithium ion battery 59 from the charge control unit 88 through the charge terminals 65 and the connection terminals 75.

The above-mentioned charge voltage is divided in two stages, preparatory charge voltage lower than a set voltage of the lithium ion battery 59 and rapid charge voltage higher than the set voltage. At an initial stage of charge, charge is carried out with the preparatory charge voltage during a predetermined period.

Charging is stopped when a predetermined time elapses after voltage of the lithium ion battery 59 reached a predetermined voltage or after charge current to the battery 59 reached a predetermined value.

After charging to the lithium ion battery 59 was finished, the crawler 50 stands by maintaining the charge value until it replaces a crawler 50 of another group of which remaining electricity has become less than 30%.

Remaining electricity of the lithium ion battery 50 is calculated by subtracting amount of electric power consumed during running of the crawler 50 from charge amount of the lithium ion battery 59, or presumed from battery voltage.

Thus, in the charging state of the crawler 50, charge current is added to the lithium ion battery 59 from the connection terminal 75 of the charge apparatus 70 through the charge terminal 65 of the crawler 50, and when charging is completed, charging is stopped automatically.

The electric source of the boat race game machine 1 is turned on prior to opening of a shop installed with the boat race game machine 1. The self running bodies 50 move to the respective charge positions, remaining electricity of each battery is detected and only running bodies 50 found that charge is necessary go back to come into contact with the terminal for charge of the lithium ion battery.

When the electric source of the boat race game machine 1 is turned on, the lighting apparatus 15 is lighted, an actual scene of a boat race is displayed on the display 16, fanfare and presentation of racers are broadcasted from the loudspeaker 14, and six motorboat models 6 gather in the neighborhood of the start.

Data of condition of wing and wave and past data of the motorboats and racers are displayed on the display 16 based on signals from the game board 81. Odds based on the data are calculated in the game board 81 and displayed on the display 16. Orders of arrival of the motorboat models 2 are calculated and decided with probability corresponding to the odds (of course, the orders of arrival are not displayed on the display 16).

The player stands in front of the satellite 7, inserts medals in the coin slot 10, and votes expected winning motorboat models 2 or racer models 3 according to the number of the inserted medals with reference to the odds and other data displayed on the display 16.

When it becomes a time for starting, the six motorboat models 2 run preparatively toward the start line so that the motorboat models 2 pass through the start line when a signal of start is given. Calculated position data of the motorboat models 2 are transmitted from the game board 81 to the self running bodies 50 through the carrier control unit 82 and the LED 86 serially corresponding to characters of the motorboat models 2, ahead type or last spurt type for example, and each crawler 50 runs to its own position based on the calculated position data given to it.

As the result, the motorboat models 2 run along various courses and develop a ding-dong race. Therefore, the player can enjoy the same thrill as in an actual boat race.

When a predetermined time has elapsed after vote, the race starts and the motorboat models 2 start altogether. Then a ding-dong race is carried out based on a race development previously selected by the game board 81.

When the six motorboat models 2 reach the goal, fanfare sounds from the loudspeaker 14, and orders of arrival and dividend are displayed on the display 16. At a corresponding satellite 7, the dividend is added.

The crawler 50 having finished the race returns to the charge apparatus 70 running backward between the guide pieces 72, and stops at a position near the striker 74, the connection terminal 75 and the infrared ray transmitter-receiver 76.

At this stop position, information of charge of the lithium ion battery 59 is exchanged between the infrared ray transmitter-receiver 67 of the crawler 50 and the infrared ray transmitter-receiver 76 of the charge apparatus 59. When charge is unnecessary, the crawler 50 stands by at this position. When charge is necessary, this information is sent from the charge control unit 88 to the game board 81 through the environ control unit 87, back running control signal is transmitted from the game board 81 to the LED 86 through the carrier control unit 82, the infrared ray receiver 68 of the crawler 50 receives the back running control signal, the crawler 50 goes back, the charge terminal 65 of the crawler 50 is connected with the connection terminal 75, and the electric source switch 66 is turned off by the striker 74 of the charge apparatus 66. Then, charge current is supplied to the lithium ion battery 69 from the charge apparatus 70 through the connection terminal 75 and the charge terminal 65. When the charging is completed, charging action of the charge apparatus 70 is stopped automatically.

In this state, since the electric source switch is turned off, even if working of the boat race game machine 1 is stopped for a long period, natural discharge of the lithium ion battery is prevented.

When one or more of six self running bodies 50 belonging to one group require charging of the lithium ion battery 59, lithium ion batteries 59 of other self running bodies 50 are also charged. Therefore, the lithium ion batteries 59 of the self running bodies 50 of one group are always in about even charge conditions, so that development of the race is not obstructed and charge administration is easy.

A time required for the lithium ion battery 59 to discharge to a 30% remaining electricity condition from a full charge condition owing to continuous running of the crawler 50 is larger than a time required for the lithium ion battery 59 to be charged by the charge apparatus 70 to the full charge condition from the 30% remaining electricity condition. Therefore, even if the boat race game machine 1 is worked continuously, any one of the lithium ion batteries 59 of twelve self running bodies 50 does not come into a condition not charged properly.

Since remaining electricity is always more than 30% in all lithium ion batteries 59, even if electric source of a game place installed with the boat race game machine 1 is turned off for long period because the game place is closed several days for example, it is avoided that the lithium battery 59 is over-discharged and damaged.

Amount of self-discharge of the lithium ion battery 59 itself is very low and electric power consumed by a protecting circuit attached to the lithium ion battery 59 is very little. Therefore, the damage of the lithium battery 59 owing to the over-discharge is prevented surely.

Since the crawler 50 is provided with two oscillator coils 69 in front and rear, not only position but also running direction of the crawler 50 is detected surely, so that running of the motorboat model 2 can be controlled with high accuracy.

When one or more of six self running bodies 50 belonging to one group requires charging of the lithium ion battery 59, only the lithium ion battery 59 requiring charge may be charged. Since charge of the lithium ion battery 59 not requiring charge can be avoided, the number of times of charge of each lithium ion battery 59 is reduced and life of the lithium ion battery 59 can be prolonged.

In case that only the lithium ion battery 59 requiring charge is charged as described above, in place of the crawler 50 having the lithium ion battery 59 requiring charge, one of the self running bodies 50 belonging to another group may participate in the race. Or all self running bodies 50 belonging to another group may participate in the race.

In the above-mentioned embodiment, after the race ended, the crawler 50 moves toward the charge apparatus 70 automatically. But, the crawler 50 may be moved to the charge apparatus 70 by manual remote control.

Further, the lithium ion battery 59 may be charged by manual control at a position near the charge apparatus 70.

The motorboat model 2 itself may constitute a crawler having a battery mounted. In this case, the motorboat model 2 is led to a place not seen from the spectators above the water of the water tank 4 and charged there by the charge apparatus 70.

Racehorse models may be used in place of the motorboat models 2. The racehorse model may be made so as to run following the crawler 50 disposed under the runway plate 17. Or the crawler 50 may be provided integrally under the racehorse model.

The lithium ion battery 59 on the crawler 50 may be charged automatically or by manual control when it is detected that the crawler 50 has run during a predetermined time or by a predetermined distance.

The electric source switch 66 of the crawler 50 may be turned off by the striker 74 when working of the boat race game machine 1 is stopped for a long period, irrespective to charging.

Of course, the present invention can be applied to a game apparatus simulating a sport such as soccer or polo that players run on a field.

The crawler 50 may be provided with a CPU and a memory. If treatment ability of the CPU and storing ability of the memory are high enough, running command data of the motorboat models 2 can be stored in the memory, and the motorboat model 2 can run autonomously by action of the CPU according to running pattern given to the motorboat model 2 from the game board 81.

The motorboat model 2 and the crawler 50 may run on an undulating runway plate or an undulating supporting surface. In this case, the permanent magnet 51 provided on the crawler 50 is raised and lowered freely by a pantograph or the like so as to be adjacent to the permanent magnet 27 of the towing body 25 always.

In the above-mentioned embodiment, the motorboat models 2 reach the goal finally with previously decided orders of arrival. Alternatively, several game developments having respective orders of arrival decided previously may be prepared previously so that the game board 81 selects one of the game developments arbitrarily and the motorboat model 2 is run according to the selected game development.

The crawler 50 may be provided with a model such as a horse model detachably and the lithium ion battery may be provided on the crawler or the model detachably. The crawler, the model and the lithium ion battery having different lives can be used effectively by renewing each of them when its life is exhausted.

If the model and the crawler are formed integrally, cost is reduced, rigidity is increased, and the combined model and crawler can run freely on an undulating runway surface because no runway plate is inserted between the model and the crawler.

Industrial Applicability

The present invention can be applied to a crawler driving apparatus and a game apparatus in which a storage battery mounted on a crawler is charged with electricity.

What is claimed is:

1. A crawler driving apparatus for a game apparatus, the crawler apparatus comprising:

a crawler having at least one electric storage battery for self running of the crawler on and along a supporting surface;

an electric charging apparatus along the supporting surface to which the crawler can run to cause the storage battery thereof to be connected to the charging apparatus and charged with electricity by the charging apparatus in a state in which the crawler is adjacent to or not separated from the supporting surface and wherein said supporting surface has a stand-by position, to which the crawler is caused to run after a game is over, and a charging position different from the stand-by position;

output means provided on said crawler for outputting a signal representing remaining electricity in the battery when the crawler has reached said stand-by position;

input means provided on said charging apparatus to receive said signal representing remaining electricity from said output means when the crawler is at said stand-by position; and a charge control unit for determining that charging of the storage battery is necessary when the signal representing remaining electricity indicates that the remaining electricity in the storage battery is less than a predetermined amount and for causing the crawler to move from said stand-by position to said charging position, when the charge control unit determines that charging is necessary, in such a manner that charge terminals provided on said crawler are connected to connection terminals of said electric charging apparatus to carry out electric charging of the storage battery.

2. The crawler driver apparatus as claimed in claim 1, wherein said charge control unit is operative to charge the storage battery when the crawler has run by at least one of a predetermined time and a predetermined distance.

3. The crawler driver apparatus as claimed in claim 1, wherein said crawler has an electric switch which is cut off to stop the crawler when the crawler is caused to move to connect the charge terminals on the crawler with the connection terminals of the charging apparatus.

4. The crawler driver apparatus as claimed in claim 1, wherein said charge terminals and said connection terminals form three sets of terminals, a first set of terminals being for charging, a second set of terminals being for transmitting the quantity of electricity remaining in the storage battery, and a third set of terminals being earth terminals for the terminals of the first and second sets.

5. A game apparatus comprising:

a plurality of running objects configured to run along a course, wherein each of said running objects is caused to run by a crawler driven by a crawler driving apparatus and which self-runs on and along a supporting surface by means of a storage battery on the crawler and wherein an electric charging apparatus is disposed at a position such that the crawler can run along the supporting surface and such that the storage battery is connected to the charging apparatus in a state in which the crawler is adjacent to or not separated from the supporting surface and wherein said supporting surface has a stand-by position to which the crawler is caused to run when a game is over; and wherein said crawler driving apparatus comprises:

output means provided on the crawler for outputting a signal representing remaining electricity in the battery when the crawler has reached said stand-by position;

input means provided on the charging apparatus to receive said signal representing remaining electricity from the output means when the crawler is at said stand-by position; and a charge control unit for determining that charging of said storage battery is necessary when the signal representing remaining electricity indicates that the remaining electricity in the storage battery is less than a predetermined amount and for causing the crawler to move from said stand-by position to said charging position when the charge control unit determines that charging is necessary, in such a manner that charge terminals provided on the crawler are connected to connection terminals of the charging apparatus to carry out electric charging of the storage battery.

* * * * *